US009254983B1

(12) United States Patent
Jordan et al.

(10) Patent No.: US 9,254,983 B1
(45) Date of Patent: Feb. 9, 2016

(54) EASILY ATTACHABLE CABLE GUIDE

(71) Applicants: Michael C. Jordan, Knoxville, TN (US); David S. Jordan, Knoxville, TN (US)

(72) Inventors: Michael C. Jordan, Knoxville, TN (US); David S. Jordan, Knoxville, TN (US)

(73) Assignee: iTool Equipment Holding LLC, Knoxville, TN (US)

( * ) Notice: Subject to any disclaimer, the term of this patent is extended or adjusted under 35 U.S.C. 154(b) by 429 days.

(21) Appl. No.: 13/694,570

(22) Filed: Dec. 13, 2012

Related U.S. Application Data

(60) Provisional application No. 61/630,531, filed on Dec. 14, 2011.

(51) Int. Cl.
*B65H 57/06* (2006.01)

(52) U.S. Cl.
CPC ..... *B65H 57/06* (2013.01)

(58) Field of Classification Search
CPC ..... B25B 1/04; B25B 1/2494; B25B 5/067; B25B 5/082; B25B 5/101; B25B 5/125; B25B 13/32
USPC ..... 269/3, 6, 95, 143, 249; 29/244, 255, 29/268, 278
See application file for complete search history.

(56) References Cited

U.S. PATENT DOCUMENTS

| | | | | |
|---|---|---|---|---|
| 5,537,727 | A * | 7/1996 | Mayer | 29/237 |
| 5,671,520 | A * | 9/1997 | Scarborough | 29/237 |
| 5,991,997 | A * | 11/1999 | Schley et al. | 29/426.5 |
| 8,266,775 | B2 * | 9/2012 | Bentley et al. | 29/268 |
| 8,341,818 | B1 * | 1/2013 | Ralph | 29/254 |

* cited by examiner

*Primary Examiner* — Lee D Wilson
(74) *Attorney, Agent, or Firm* — Michael E. McKee

(57) ABSTRACT

A tool which is positionable adjacent a relatively sharp edge around which or past which a sheathed cable is desired to be routed includes a pair of clamping members which are manipulable with the hand of a user and adapted to be clamped to an item disposed adjacent the relatively sharp edge. In addition, the tool includes a pair of guide members which are attached to the clamping members of the tool and which provide, when the tool is clamped about the item, a substantially enclosed, smooth-surfaced passageway through which the sheathed cable can be routed to eliminate any contact between the relatively sharp edge and the sheathed cable routed around or past the relatively sharp edge. The defined passageway reduces the likelihood that the relative sharp edge will damage the sheathing of the cable as the cable is routed around or past the relatively sharp edge.

17 Claims, 4 Drawing Sheets

EASILY ATTACHABLE CABLE GUIDE

The benefit of Provisional Application Ser. No. 61/630,531, filed Dec. 14, 2011, and entitled EASILY ATTACHABLE CABLE GUIDE, is hereby claimed. The disclosure of this referenced provisional patent application is incorporated herein by reference.

BACKGROUND OF THE INVENTION

This invention relates generally to hand tools and relates, more particularly, to such a tool which facilitates the movement of a cable around or past a relatively sharp edge.

When routing a sheathed electrical cable through a ceiling or wall, it occasionally becomes necessary to route the cable around a corner which exposes the cable to a relatively sharp edge. Such an edge may be provided by the edge of a corner of a wall stud opening through which the cable must be routed or the edge of a metal grid commonly used in the support of a suspended ceiling. If the sheathing of the cable were to hang upon the relatively sharp edge when the cable is being pulled around or past the relatively sharp edge, any further pulling upon the cable could damage the sheathing surrounding the conducting wires of the cable.

It would be desirable to provide a device which reduces the likelihood that the sheathing which surrounds the conducting wires of a sheathed cable will be damaged as it is routed around or past a relatively sharp edge.

Accordingly, it is an object of the present invention to provide a new and improved tool which reduces the likelihood that the sheathing which surrounds the conducting wires of a sheathed cable routed around or past a relatively sharp edge will be damaged as the cable is pulled around the relatively sharp edge.

Another object of the present invention is to provide such a tool which can be attached in a stationary position at a location adjacent the relatively sharp edge for providing a relatively smooth surface across which the cable can be alternatively routed.

Still another object of the present invention is to provide such a tool which can be quickly attached to or detached from a location adjacent the relatively sharp edge.

Yet another object of the present invention it to provide such a tool whose portions serve to guide the cable along a preferred, or less damaging, route around or past the relatively sharp edge.

A further another object of the present invention is to provide such a tool which is relatively small in size and capable of being manipulated with the hand of a user during use.

A still further object of the present invention is to provide such a tool which is relatively uncomplicated in structure, yet effective in operation.

SUMMARY OF THE INVENTION

This invention resides in a tool which is positionable adjacent a relatively sharp edge around which or past which a sheathed cable is desired to be routed.

The tool includes a pair of clamping members which are manipulable with the hand of a user and are adapted to be clamped to an item disposed adjacent the relatively sharp edge. In addition, the tool includes at least one guide member which is attached to a clamping member of the tool for providing a relatively smooth surface which is engagable by the sheathing of the cable as the cable is routed around or past the relatively sharp edge for reducing the likelihood that the relative sharp edge will damage the sheathing of the cable as the cable is routed around or past the relatively sharp edge.

DETAILED DESCRIPTION OF AN ILLUSTRATIVE EMBODIMENT

Figure 1:
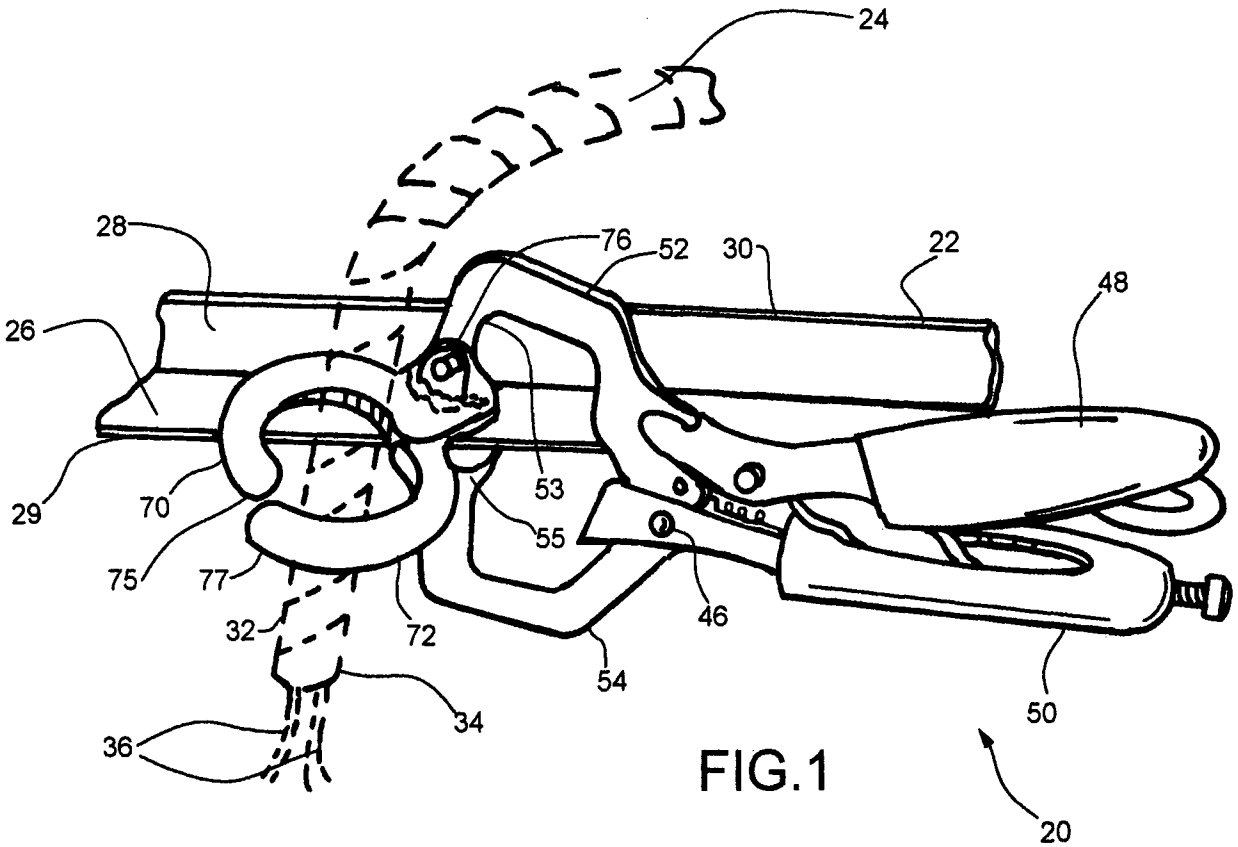
FIG. 1 is a perspective view of a tool embodying features of the present invention shown being utilized in an exemplary environment in which the tool is expected to be used.

Turning now to the drawings in greater detail and considering first FIG. 1, there is illustrated an embodiment, generally indicated 20, of a hand-manipulable tool within which features of the present invention are embodied and shown being used in an exemplary environment of intended use. In particular, the depicted environment of FIG. 1 includes at least one angle member 22 around which a sheathed electrical cable 24 is desired to be routed. The angle member 22 is L-shaped in cross section having legs 26 and 28 which are joined together at a right angle. Exemplary angle members comparable to the member 22 are commonly employed in metal grids used to support a suspended ceiling (e.g. a T-grid ceiling) wherein the angle members criss-cross the ceiling to form rectangular patterns within which rectangular ceiling sections, or panels, can be positioned.

It is not uncommon for the legs 26 or 28 of the angle member 22 to terminate along a relatively sharp edge 29 or 30, and if the cable 24 were to be routed across either of the relatively sharp edges 29 or 30, as may be the case when routing of electrical conduits through the ceiling, the sharp edge 29 or 30 could hang upon the sheathing, indicated 32, of the cable 24. If such a hanging were to occur, additional pulling or tugging upon the cable end, indicated 34, could harmfully stretch or otherwise damage the sheathing 32 and expose the conducting wires, indicated 36, of the cable 24.

Although the exemplary FIG. 1 environment involves an angle member 22 about which a cable 24 is desired to be routed, the tool 20 described herein could be utilized in other environments to, for example, facilitate the routing of a cable through an opening formed in a wall stud or to facilitate the turning of the cable at a ninety degree turn past a relatively sharp edge. Accordingly, the principles of the present invention can be variously applied.

Furthermore and although the exemplary FIG. 1 environment shown and described herein involves a sheathed cable 24 including conducting wires 36 surrounded by a metallic wrapping, sheathed cables with which the depicted tool 20 can be used include, but are not limited to, branch circuits, coax cable, multi-conductor cable, data wire or fiber optic cable. Accordingly, the term "sheathed cable" as used herein should be interpreted broadly.

With reference to FIGS. 2-5, the tool 20 includes a gripping portion 40 including a pair of pincer-like clamping members 42, 44 which are pivotally joined to one another by way of a pivot pin 46. In addition, the portions of the pincer-like members 42, 44 disposed to one side of the pivot pin 46 (i.e. toward the rightward end, as viewed in FIG. 2) provide hand grips 48, 50 with which the tool 20 is clamped about an item (e.g. the leg 26 of the FIG. 1 angle member 22), and the portions of the pincer-like members 42, 46 disposed to the other side of the pivot pin 46 opposite the grips 48, 50 provide jaws 52, 54 of the tool 20.

In addition, one of the clamping members 44 includes a C-shaped portion which provides a jaw 54 of the tool 20, while the grip 50 of the clamping member 44 is pivotally attached to the jaw 54. With a tension spring 60 acting between the grip 50 and the jaw 52, a linkage member 56 being joined at each end to a corresponding grip 48 or 50, a release arm 64 which is pivotally attached to the grip 50 for acting upon the linkage member 56 (i.e. for releasably locking the jaws 52, 54 in a clamped condition about an item) and an adjustment screw 66, the gripping portion 40 is capable of functioning in a manner similar to that of a pair of common vice grips (not shown) which can be releasably secured to an item as the jaws 52, 54 of the tool 20 are moved into and out of clamping relationship with the item. It will therefore be understood that the jaws 52, 54 or, more particularly, the jaw ends 53 and 55, respectively, deposited at the ends of the jaws 52 and 54 opposite the pivot pin 46, are capable of being moved toward or away from one another between a clamped condition at which the jaw ends 53, 55 are clamped about the item (e.g. the leg 26 of the FIG. 1 angle member 22) and a condition of release at which the jaw ends 53 and 55 are not clamped about the item.

Along the same lines and as is the case with a common pair of vice grips, the adjustment screw 66 can be rotated (and thereby be adjusted in position lengthwise of the tool 20) to a position at which the jaw ends 53 and 55 are closed, and thereby clamped, about an item disposed between the jaw ends 53 and 55 while the release arm 64 is pivoted to a position which locks the jaw ends 53 and 55 into a closed position about the item. Once the tool 20 is in the closed (and locked) position, the release arm 64 can be squeezed against the underside (as viewed in FIG. 2) of the grip 48 to release the jaw ends 53 and 55 from the locked position about the item.

Within the depicted tool 20, each jaw 52 or 54 is generally elongated in shape wherein the jaw 52 has two opposite ends 53 and 57 and the jaw 54 has two opposite ends 55 and 59. It is the ends 57 and 59 which are connected together by way of the pivot pin 46 so that as the jaws 52 and 54 are pivotally moved relative to one another about the pin 46 as the hand grips 48 are manipulated (i.e. pivoted relative to one another about the pivot pin 46), the jaw ends 53 and 55 are moved toward and away from one another between a clamped condition about an item and a condition of release. Moreover, each jaw 52 or 54 is generally flat, or planar, in form, and is generally co-planar with the planar form of the other jaw 54 or 52. The plane, indicated 71 in FIG. 3, within which the planar form of the jaws 52 and 54 substantially lies is also the plane within which the relative movement of the jaws 52 and 54 is substantially confined as the jaw ends 53 and 55 are moved toward and away from one another between the clamped condition and the condition of release.

Figure 2:
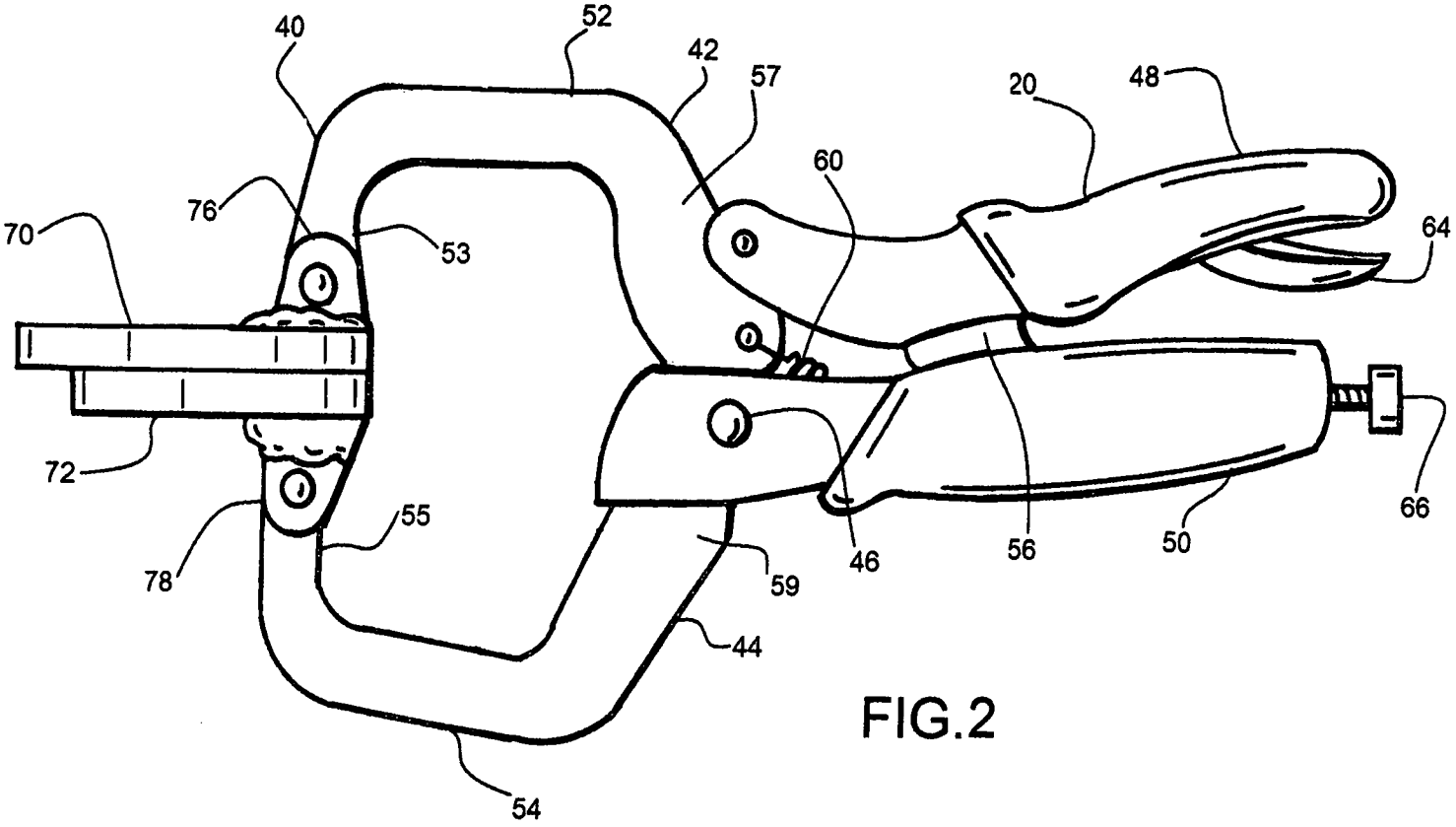
FIG. 2 is a side view of the FIG. 1 tool and illustrating the relationship of the jaws of the tool when the tool is positioned in its fully closed condition.
Figure 3:
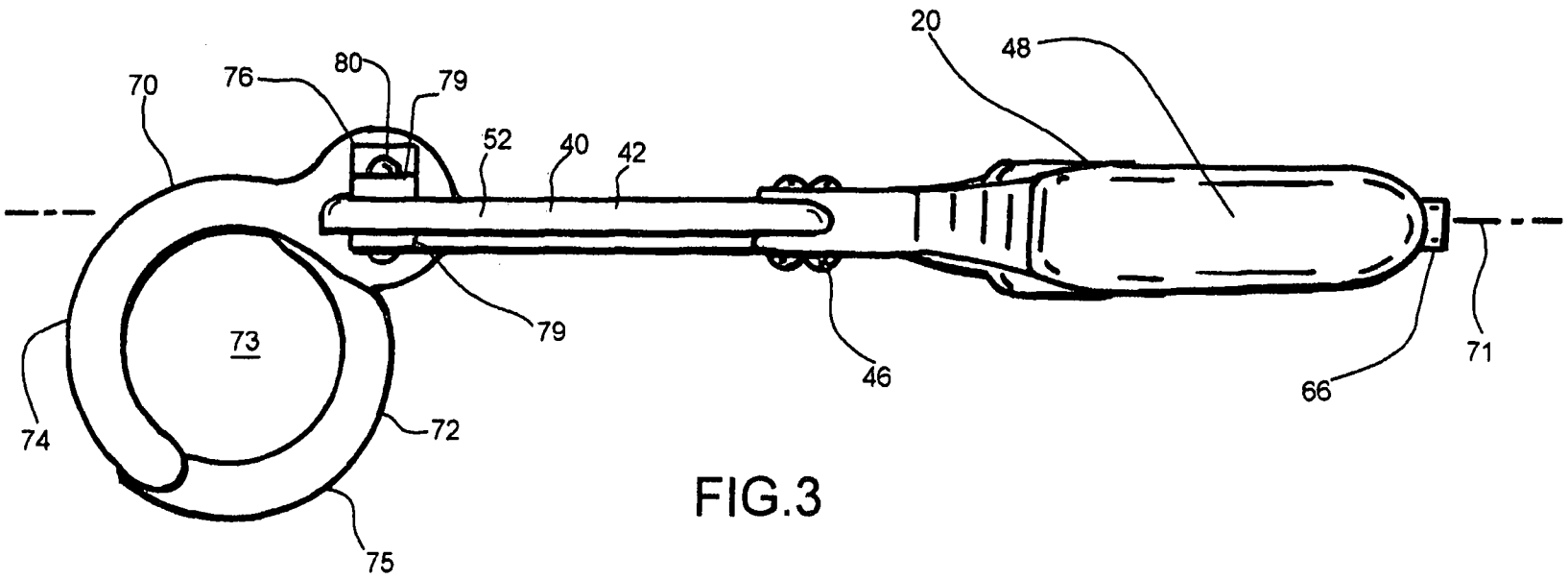
FIG. 3 is a plan view of the FIG. 1 tool as seen from above in FIG. 2.
Figure 4:
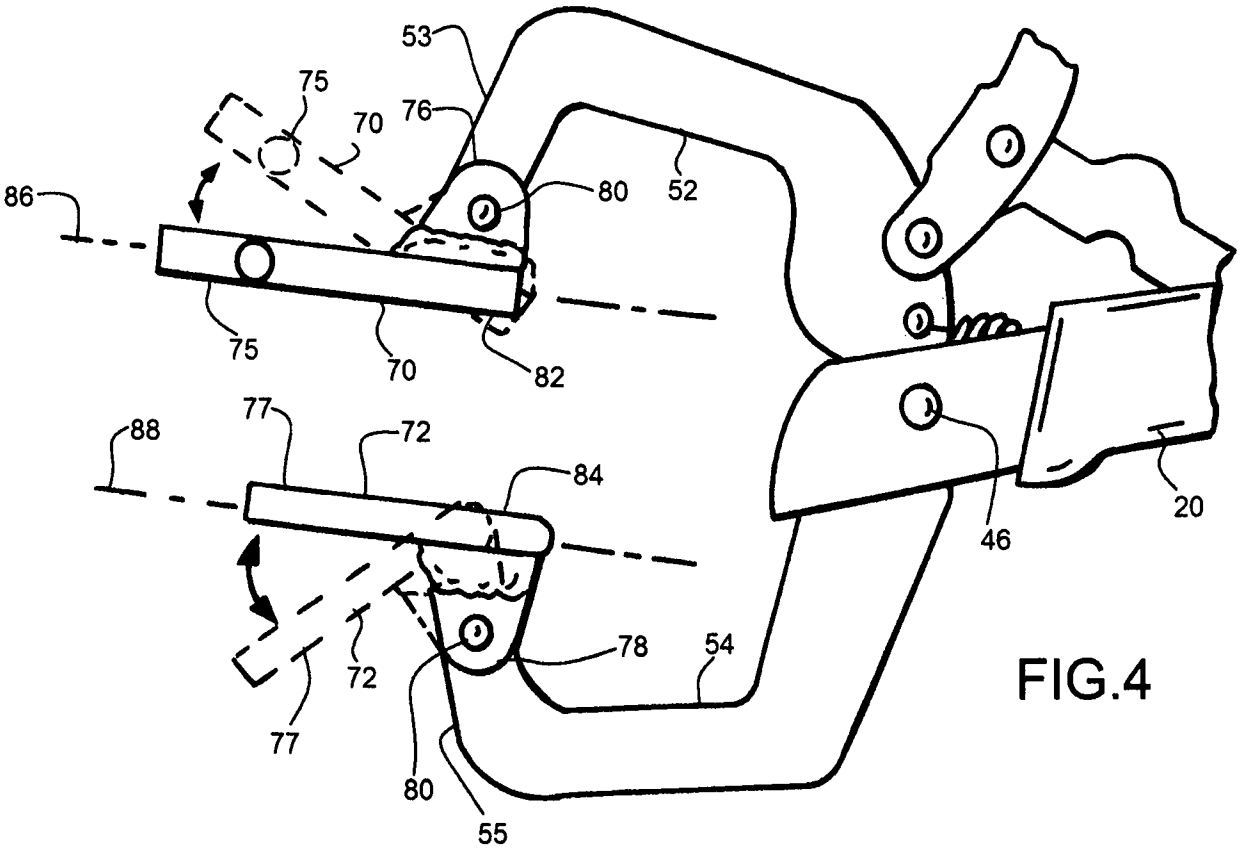
FIG. 4 is a view of a fragment of the FIG. 1 tool as seen in FIG. 2, but drawn to a slightly larger scale and illustrating the relationship of the jaws of the tool when the tool is positioned in its fully opened condition.

With reference to FIGS. 2-4, the tool 20 further includes a pair of guide members 70, 72 which are pivotally attached to the jaws 52, 54, respectively, of the tool 20 so as to extend to one side thereof and to collectively provide a smooth-surfaced, substantially circular guideway or passageway 73 (FIG. 3) through which the cable 24 can be routed when the tool 20 is clamped to an item (e.g. the leg 26 of the FIG. 1 angle member 22) adjacent a sharp edge 29 or 30. In the depicted tool 20, each guide member 70 or 72 includes a substantially C-shaped portion 74 or 75 (having relatively smooth surfaces thereabout) and an attachment portion 76 or 78 which is fixedly secured (as with welds) to the C-shaped portion 74 or 75. As exemplified by the attachment portion 76 best seen in FIG. 3, each attachment portion 76 or 78 includes a pair of flanges 79 which are positioned on opposite sides of a corresponding jaw 52 or 54 of the tool 20 and which are attached thereto with a pivot pin 80. If desired, the pivot pin 80 can be provided by the shank of a threaded fastener which accommodates the removal of the guide members 70 and 72 from the jaws 52 and 54 to thereby permit a replacement of the guide members 70 and 72 with guide members which provide collectively provide a cable passageway 73 of alternative size. Of course, the capacity to detach the guide members 52 and 54 from the jaws 52 and 54 will also facilitate the change-out of guide members which may become damaged or worn.

This pivotal joinder between the attachment portions 76 and 78 to the jaws 52 and 54, respectively, enables each guide member 70 or 72 to pivot relative to its corresponding jaw 52 or 54 (between, for example, the solid-line and phantom-line conditions illustrated in FIG. 4) to enable the C-shaped portions 74 of the guide members 70, 72 to be positioned flat against a surface of the item against which the jaws 52, 54 are desired to be clamped. Thus, the capacity of the guide members 70, 72 to pivot relative to the jaws 52, 54 permits the guide members 70, 72 to lay flat against a surface of the item about which the jaws 52, 54 are desired to be clamped—no matter how far apart the jaws 52, 54 might be disposed—when the jaws 52, 54 are ultimately clamped about the item. Therefore and as long as the opposite surfaces of the item (i.e. the opposite surfaces of the leg 26 of the FIG. 1 angle member 22) against which the tool 20 is clamped are substantially parallel to one another, the planes, indicated 86 and 88 in FIG. 4 and within which the C-shaped forms of the guide members 70 and 72 are arranged, are substantially parallel to one another when the clamping members 70, 72 are in a clamped condition about the item.

It also follows that the guide members 70 and 72 have item-contacting portions, indicated 82 and 84 in FIG. 4, which engage the opposite surfaces of the item (e.g. the leg 26 of the FIG. 1 angle member 22) when the tool 20 is clamped thereabout. Therefore and as the clamping members 42, 44 are clamped about the item, each item-contacting portion 82 or 84 is disposed substantially between the surface of the item being engaged by the portion 82 or 84 and the corresponding jaw end 53 or 55 to which the clamping member 70 or 72 is attached.

It is also a feature of the tool 20 that the guide members 70 and 72 thereof are disposed in an angular relationship with respect to the plane of the jaws 52 and 54 so that when the jaws 52, 54 are clamped about an item disposed adjacent a relatively sharp surface, the guide members 70, 72 are disposed to one side of the plane 71 (FIG. 3) of permitted relative movement between the jaws 52 and 54. In other words and as best shown in FIG. 3, the aforedescribed substantially circular passageway 73 collectively provided by the C-shaped portions 74 and 75 of the guide members 70 and 72 when clamped about an item is disposed entirely to one side of the plane 71. Such a disposition of the passageway 73 has been found to be well-suited for maintaining the sheathed cable 24 which is routed through the passageway 73 at a safe distance away from an edge 29 of the item 26 to which the tool 20 is clamped.

To use the tool 20, the jaws 52 and 54 are moved to an open condition, as depicted in FIG. 4, which condition spaces both the jaw ends 53 and 55 and the guide members 70 and 72 in a spaced-apart condition. While the guide members 70 and 72 are in this spaced-apart condition, a sheathed cable 24 (FIG.

1) can be inserted sideways into the gap provided between the free ends of the guide members 70 and 72 so that the sheathed cable 24 is thereby positioned within the spacing provided by the Cs of the guide members 70 and 72. With the sheathed cable 24 held (by the hand of a user) within the arcuate, C-shaped form of one of the guide members 70 or 72, the jaw ends 53 and 55 can be subsequently closed, and thereby clamped, about an item, such as the leg 26 of the angle member 22 (FIG. 1).

The bringing together of the jaw ends 53 and 55 into a clamped condition about the item (e.g. the leg 26) securely locks the tool 20 to the item (e.g. the leg 26) and brings the guide members 70 and 72 into a condition which substantially encloses the sheathed cable 24 within the passageway 73. It will be understood that as the tool 20 is clamped to the item 26 and the guide members 70, 72 are arranged to one side of the item 26, the passageway 73 defined by the guide members 70, 72 are disposed to one side of the item 26, as well. Enclosed within the passageway 73 in such a manner, the sheathed cable 24 is free to contact any of the relatively smooth interior surfaces of the guide members 70 and 72 as the sheathed cable 24 is pulled therethrough while it is also prevented from escaping the confines of the passageway 73.

Because the passageway 73 is disposed to one side of the plane 71 of permitted relative movement of the jaws ends 53 and 55 (rather than being co-incident with the plate 77), the passageway 73 can be more easily positioned away from the sharp edge 29 or 30 from which the sheathed cable 24 is desired to be protected. Furthermore and because the guide members 70 and 72 are permitted to be pivoted relative to the jaw ends 53 and 55 through a limited range of pivotal movement (e.g. through about sixty degrees), the tool 20 is more easily to manipulate into place about the item 26 with the hand of an individual.

It follows from the foregoing that a tool 20 has been described which is positionable adjacent a relatively sharp edge 29 or 30 around which or past which a sheathed cable 24 is desired to be routed wherein the tool 20 includes a pair of clamping members 42, 44 which are manipulable with the hand of a user and adapted to be clamped to a surface of an item (e.g. the angle member leg 26 of FIG. 1) disposed adjacent the relatively sharp edge 29 or 30. Moreover, the tool 20 includes at least one guide member 70 or 72 which is attached to a clamping member 42 or 44 of the tool 20 for providing a relatively smooth surface which is engagable by the sheathing 32 of the cable 24 as the cable 24 is routed around or past the relatively sharp edge 29 or 30 to thereby reduce the likelihood that the relative sharp edge 29 or 30 will damage the sheathing 32 of the cable 24 as the cable 24 is routed around or past the relatively sharp edge 29 or 30.

It will be understood that numerous modifications and substitutions can be had to the aforedescribed embodiment 20 without departing from the spirit of the invention. Accordingly, the aforedescribed embodiment 20 is intended for the purpose of illustration and not as limitation.

The invention claimed is:

1. A tool positionable adjacent a relatively sharp edge around which or past which a sheathed cable is desired to be routed, the tool comprising:

a pair of clamping members which are manipulable with the hand of a user and adapted to be clamped to an item disposed adjacent the relatively sharp edge; and vice gripping mechanisms associated with the clamping members enabling the clamping members to be moved relative to one another between a clamped condition at which the clamping members are clamped about the item and a condition of release so that upon clamping the pair of clamping members about the item, the tool remains clamped to the item in a stationary relationship with respect thereto and so that the hand of the user can be removed from the tool, thereby leaving the tool in a clamped condition about the item; and at least one guide member which is attached to a clamping member of the tool for providing a relatively smooth surface adjacent the item and which is engagable by the sheathing of the cable as the cable is routed around or past the relatively sharp edge for preventing the relatively sharp edge from damaging the sheathing of the cable as the cable is routed around or past the relatively sharp edge;

elongated jaws wherein each jaw has two opposite ends and the jaws are pivotally connected to one another at one end of each jaw to accommodate a movement of the other end of one jaw toward and away from the other end of the other jaw; and each clamping member of said pair of clamping members is provided by a corresponding one of the other ends of the jaws so that as said other ends of the jaws are moved toward and away from one another, the clamping members are moved into and out of clamping relationship with the item.

2. The tool as defined in claim 1 wherein said other ends of the jaws are moved relative to one another within a plane of movement as the clamping members are moved into and out of clamping relationship with the item, and the at least one guide member is disposed to one side of said plane of movement.

3. The tool as defined in claim 2 wherein the at least one guide member has a form which is oriented substantially in a plane, and said plane of the guide member form is oriented substantially normal to said plane of movement.

4. The tool as defined in claim 2 wherein said at least one guide member has a item-contacting portion which is disposed in such a relationship to the corresponding clamping member to which the clamping member is joined so that when the clamping members are clamped to the item, the item-contacting portion is disposed between the item and the other end of the jaw of the corresponding clamping member, and the at least one guide member is pivotally joined to its corresponding clamping member to accommodate a pivotal movement of the at least one guide member relative to the corresponding guide member through a limited range.

5. The tool as defined in claim 1 wherein the tool has two guide members, and each guide member of the two guide members is attached to a corresponding one of said other ends of the jaws.

6. The tool as defined in claim 5 wherein the two guide members are shaped so that when the clamping members are clamped about the item, the two guide members collectively define a substantially enclosed passageway through which the sheathed cable can be routed.

7. The tool as defined in claim 6 wherein said other ends of the jaws are moved relative to one another within a plane of movement as the clamping members are moved into and out of clamping relationship with the item, and the substantially enclosed passageway is disposed entirely to one side of said plane of movement.

8. The tool as defined in claim 6 wherein each of the guide members is substantially C-shaped in form and is disposed in such a relationship to the other guide member so that when the clamping members are clamped about the item, the C-shaped form of each guide member opens substantially toward the C-shaped form of the other guide member.

9. The tool as defined in claim 5 wherein each of the guide members is shaped so that when the clamping member are clamped about the item, the guide members collectively define a substantially circular passageway through which the sheathed cable can be routed.

10. A tool positionable adjacent a relatively sharp edge around which or past a sheathed cable is desired to be routed and wherein an item is disposed adjacent the relatively sharp edge, the tool comprising:

a pair of hand grips;

a pair of clamping members which are movable toward and away from one another as the hand grips are manually manipulated by a hand of a user for movement of the clamping members between a clamped condition about the item which is disposed adjacent the relatively sharp edge and a condition of release;

vice gripping mechanisms associated with the clamping members enabling the clamping members to be moved relative to one another between said clamped condition at which the clamping members are clamped about the item and said condition of release so that upon clamping the pair of clamping members about the item, the tool remains clamped to the item in a stationary relationship with respect thereto and so that the hand of the user can be removed from the tool, thereby leaving the tool in a clamped condition about the item; and a pair of guide members wherein each guide member is attached to a corresponding clamping member of the tool and shaped so that when the clamping members are clamped about the item, the pair of guide members collectively define a substantially enclosed, smooth-surfaced passageway through which the sheathed cable can be routed for preventing the relatively sharp edge from damaging the sheathing of the cable as the cable is routed around or past the relatively sharp edge, and wherein each clamping member has a jaw portion which is movable toward and away from the jaw portion of the other clamping member within a plane of movement as the clamping members are moved between the clamped condition and the condition of release, and the substantially enclosed passageway defined by the pair of guide members is disposed entirely to one side of said plane of movement.

11. The tool as defined in claim 10 wherein the substantially enclosed passageway collectively defined by the pair of guide members is substantially circular in cross section.

12. The tool as defined in claim 10 wherein each of the guide members is substantially C-shaped in form and is disposed in such a relationship to the other guide member so that when the clamping members are clamped about the item, the C-shaped form of each guide member opens substantially toward the C-shaped form of the other guide member.

13. The tool as defined in claim 10 wherein each guide member has a item-contacting portion which is disposed in such a relationship to the corresponding clamping member to which the guide member is joined so that when the clamping members are in a clamped condition about the item, the item-contacting portion of each guide member is disposed between the item and the corresponding clamping member, and each guide member is pivotally joined to its corresponding clamping member to accommodate a pivotal movement of the guide member relative to the corresponding guide member through a limited range.

14. A tool positionable adjacent a relatively sharp edge around which or past a sheathed cable is desired to be routed and wherein an item is disposed adjacent the relatively sharp edge, the tool comprising:

a pair of hand grips;

a pair of clamping members which are movable toward and away from one another as the hand grips are manually manipulated by a hand of a user for movement of the clamping members between a clamped condition about the item which is disposed adjacent the relatively sharp edge and a condition of release;

vice gripping mechanisms associated with the clamping members enabling the clamping members to be moved relative to one another between said clamped condition at which the clamping members are clamped about the item and said condition of release so that upon clamping the pair of clamping members about the item, the tool remains clamped to the item in a stationary relationship with respect thereto and so that the hand of the user can be removed from the tool, thereby leaving the tool in a clamped condition about the item;

a pair of guide members wherein each guide member is attached to a corresponding clamping member of the tool and having an item-contacting portion which is disposed in such a relationship to the corresponding clamping member to which the guide member is joined so that when the clamping members are clamped about the item, the item-contacting portion of each guide member is disposed between the item and the corresponding clamping member; and the guide members are shaped so that when the clamping members are clamped about the item, the pair of guide members collectively define a substantially enclosed, smooth-surfaced passageway through which the sheathed cable can be routed for preventing the relatively sharp edge from damaging the sheathing of the cable as the cable is routed around or past the relatively sharp edge, and wherein each guide member is pivotally joined to the corresponding clamping member to accommodate a pivotal movement of the guide member relative to the corresponding clamping member through a limited range.

15. The tool as defined in claim 14 wherein each guide member is releasably joined to the corresponding clamping member to facilitate the replacement of the guide member within the tool.

16. A tool positionable adjacent a relatively sharp edge around which or past which a sheathed cable is desired to be routed, the tool comprising:

a pair of clamping members which are manipulable with the hand of a user and adapted to be clamped to an item disposed adjacent the relatively sharp edge; and vice gripping mechanisms associated with the clamping members enabling the clamping members to be moved relative to one another between a clamped condition at which the clamping members are clamped about the item and a condition of release so that upon clamping the pair of clamping members about the item, the tool remains clamped to the item in a stationary relationship with respect thereto and so that the hand of the user can be removed from the tool, thereby leaving the tool in a clamped condition about the item; and at least one guide member which is attached to a clamping member of the tool for providing a relatively smooth surface adjacent the item and which is engagable by the sheathing of the cable as the cable is routed around or past the relatively sharp edge for preventing the relatively sharp edge from damaging the sheathing of the cable as the cable is routed around or past the relatively sharp edge, and wherein the at least one guide member is C-shaped in form and the relatively smooth surface provided by the at least one guide member is provided by a surface of the C-shaped form of the at least one guide member.

17. A tool positionable adjacent a relatively sharp edge around which or past a sheathed cable is desired to be routed and wherein an item is disposed adjacent the relatively sharp edge, the tool comprising:

a pair of hand grips;

a pair of clamping members which are movable toward and away from one another as the hand grips are manually manipulated by a hand of a user for movement of the clamping members between a clamped condition about the item which is disposed adjacent the relatively sharp edge and a condition of release;

vice gripping mechanisms associated with the clamping members enabling the clamping members to be moved relative to one another between said clamped condition at which the clamping members are clamped about the item and said condition of release so that upon clamping the pair of clamping members about the item, the tool remains clamped to the item in a stationary relationship with respect thereto and so that the hand of the user can be removed from the tool, thereby leaving the tool in a clamped condition about the item; and a pair of guide members wherein each guide member is attached to a corresponding clamping member of the tool and shaped so that when the clamping members are clamped about the item, the pair of guide members collectively define a substantially enclosed, smooth-surfaced passageway through which the sheathed cable can be routed for preventing the relatively sharp edge from damaging the sheathing of the cable as the cable is routed around or past the relatively sharp edge, and wherein each guide member of the pair of guide members is releasably attached to a corresponding clamping member to facilitate the replacement of the guide members within the tool.

* * * * *